US005113221A

United States Patent [19]

Kotani et al.

[11] Patent Number: 5,113,221

[45] Date of Patent: May 12, 1992

[54] IMAGE FORMING APPARATUS HAVING A PLURALITY OF TONER DEVELOPERS INCLUDING WHITE TONER

[75] Inventors: Akio Kotani; Kazuhiro Araki; Toshikazu Kawaguchi, all of Osaka, Japan

[73] Assignee: Minolta Camera Kabushiki Kaisha, Osaka, Japan

[21] Appl. No.: 261,598

[22] Filed: Oct. 24, 1988

[30] Foreign Application Priority Data

Oct. 23, 1987 [JP] Japan ..... 62-268888
Oct. 23, 1987 [JP] Japan ..... 62-268889

[51] Int. Cl.[5] ..... G03G 21/00; G03G 15/01
[52] U.S. Cl. ..... 355/208; 355/326
[58] Field of Search ..... 355/245, 246, 326, 327, 355/328, 208

[56] References Cited

U.S. PATENT DOCUMENTS 4,579,443 4/1986 Abuyama et al. ..... 355/326 X
4,845,524 7/1989 Okamoto et al. ..... 355/328 X
4,847,658 7/1989 Takebe et al. ..... 355/245
4,928,136 5/1990 Kusumoto et al. ..... 355/326 X

FOREIGN PATENT DOCUMENTS 950767 7/1974 Canada .
61-256357 11/1986 Japan .

*Primary Examiner*—Fred L. Braun
*Attorney, Agent, or Firm*—Burns, Doane, Swecker & Mathis

[57] ABSTRACT

An image forming apparatus is provided with a plurality of toner developing devices including a white toner developing one, a photosensitive member, a charger for electrically charging a surface of the photosensitive member, an optical system for exposing an image of an original to light so that an electrostatic latent image may be formed on the photosensitive member, transfer and separation chargers for transferring a toner image formed on the photosensitive member onto a copy paper, a plurality of paper passages for transporting the copy paper having thereon the transferred toner image into a transfer region in which the transfer and separation chargers are provided, a color sensor for detecting the degree of white of the copy paper, and a microcomputer for controlling a white toner image formed by the white toner developing device so as to be transferred onto the copy paper when the degree of white of the copy paper is less than a predetermined value.

7 Claims, 8 Drawing Sheets

Fig. 5 (3)
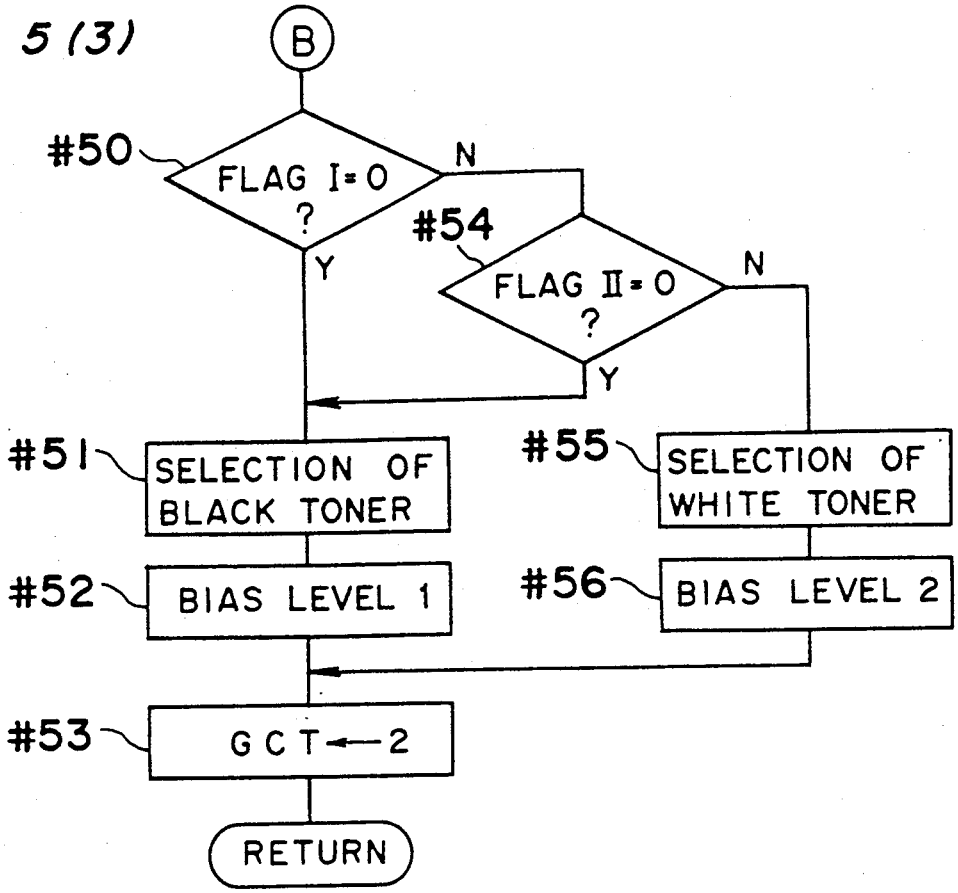
Fig. 5 (4)
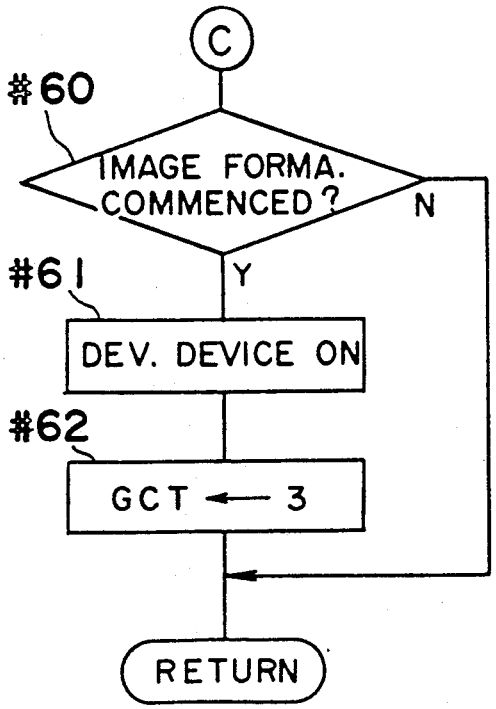
Fig. 5 (5)
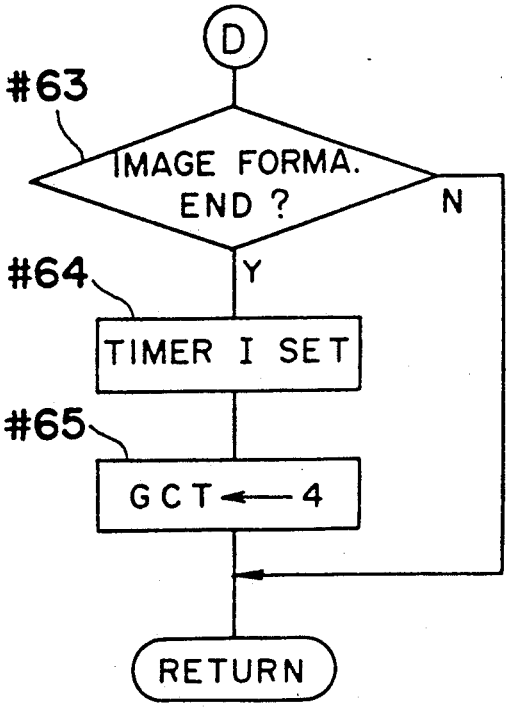

IMAGE FORMING APPARATUS HAVING A PLURALITY OF TONER DEVELOPERS INCLUDING WHITE TONER

BACKGROUND OF THE INVENTION

1. Field of the Invention

The present invention generally relates to an image forming apparatus, and more particularly, to a copying apparatus provided with a plurality of toner developing devices including a white toner developing one.

2. Description of the Prior Art

A copying apparatus which is provided with a plurality of toner developing devices and capable of copying not only in black but also in other colors, for example, red and blue is now in practical use. As to copy papers, although white papers are generally used, colored ones are occasionally employed.

Conventionally, in reproducing an original, white portions thereof are generally substituted by the ground color of a copy paper and, no particular image formation is carried out with respect to these portions.

In the above described prior art, when white papers are used as the copy papers, the white portions of the original can be readily reproduced because the ground color of each copy paper is white. However, when colored copy papers are used, the white portions of the original are inconveniently reproduced by the ground color of each colored copy paper.

For example, when white portions of a photograph is desired to be reproduced in white, these portions can not be substituted by the ground color of the colored copy paper. In contrast, when a white original document having thereon printed letters is reproduced, it is not necessary to reproduce the white portions of the original document in white. If these portions are thoughtlessly reproduced using white toner, not only the white toner is unnecessarily consumed but copying process is doubled, resulting disadvantageously in prolonged copying time.

SUMMARY OF THE INVENTION

Accordingly, the present invention has been developed with a view to substantially eliminating the above described disadvantage inherent in the prior art image forming apparatus, and has for its essential object to provide an improved image forming apparatus which is capable of reproducing an original in a fashion such that white portions thereof are reproduced in white as occasion demands whereas other portions except for the white portions are reproduced in any designated color.

Another important object of the present invention is to provide an image forming apparatus of the above described type which is capable of minimize the consumption of white toner used to reproduce the white portions of the original.

A further object of the present invention is to provide an image forming apparatus which is simple in construction and stable in functioning, and can be readily manufactured at a low cost.

In accomplishing these and other objects, the image forming apparatus according to one preferred embodiment of the present invention is provided with a plurality of toner developing devices including a white toner developing one, a white detecting means for detecting the degree of white of a copy paper and a control means for transferring a white toner image, which is formed on a photosensitive member by the white toner developing device, onto the copy paper when it has been judged, on the basis of information from the white detecting means, that the degree of white of the copy paper is less than a predetermined value.

In another aspect of the present invention, the image forming apparatus is further provided with a white area ratio detecting means for detecting an area ratio of white portions of the original. In such an image forming apparatus, the white toner image is transferred onto the copy paper when it has been judged, on the basis of information from the white detecting means and the white area ratio detecting means, that the degree of white of the copy paper is less than the predetermined value and the area ratio of the white portions of the original is less than a predetermined ratio.

According to the present invention, the white toner reproducing process is carried out with respect to a colored copy paper, which is less than the predetermined value in the degree of white, so that the white portions of the original may be reproduced on the colored copy paper upon reverse development of the white toner. Furthermore, other portions except for the white portions of the original is reproduced upon an ordinary copying process immediately before or after the white toner reproducing process. As a result, the white portions of the original are reproduced in white whereas non-white portions of the original are reproduced in any designated color upon the ordinary reproducing process.

When a white copy paper is in use, the white toner reproducing process is omitted. This fact can save copying time and prevent the white toner from being unnecessarily consumed. Furthermore, when the white toner reproducing process is needed, the development by the white toner is carried out only with respect to the white portions of the original, thus confining the consumption of the white toner to the minimum.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which:

FIG. 5(2*a*), is a flow-chart similar to FIG. 5(2), which particularly shows a modification thereof.

DETAILED DESCRIPTION OF THE PREFERRED EMBODIMENT

Figure 1:
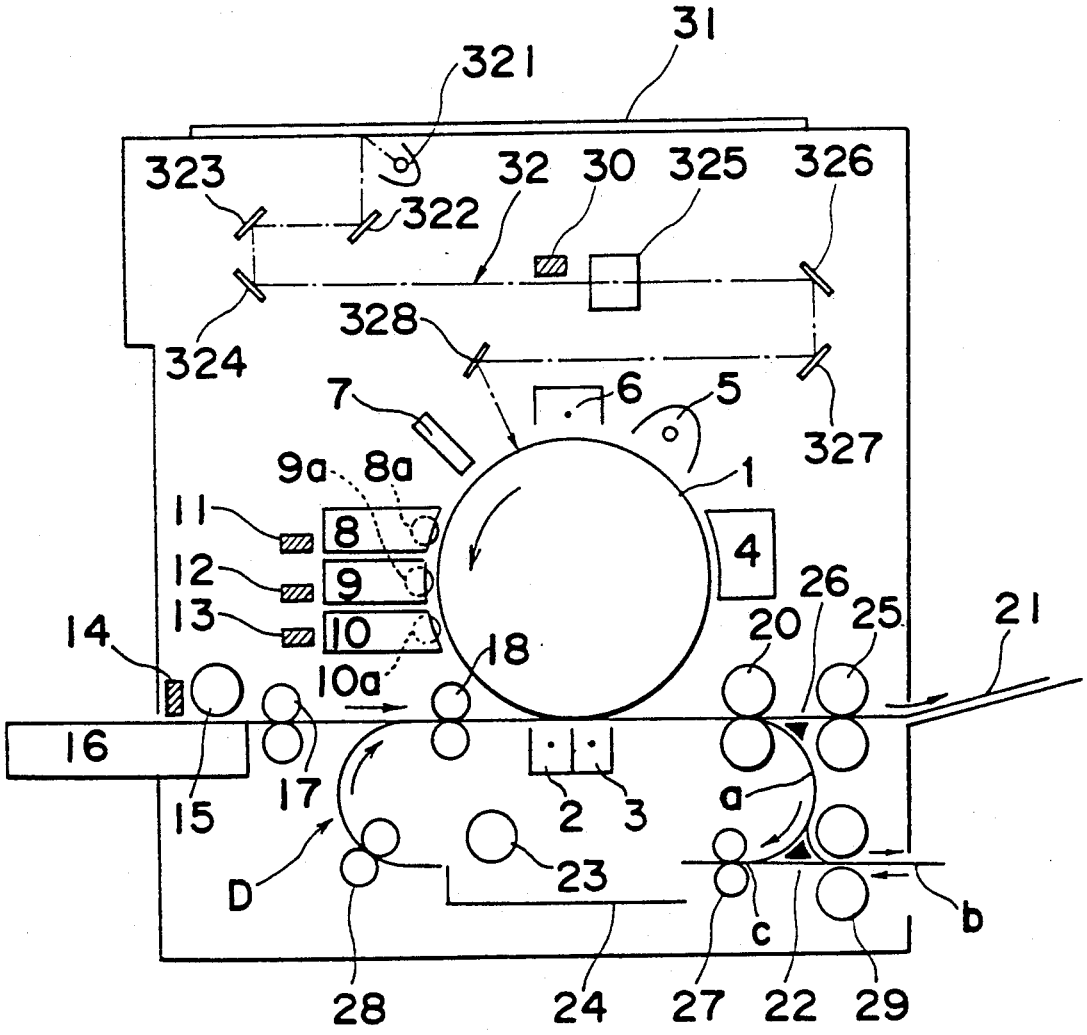
FIG. 1 is a schematic side elevational view of a copying apparatus according to the present invention.

A copying apparatus shown in FIG. 1 is a good example of an image forming apparatus according to one preferred embodiment of the present invention. The copying apparatus is internally provided with three developing devices 8, 9 and 10 and a paper transport path D used for composite copying and duplex copying.

In FIG. 1, the copying apparatus accommodates substantially at its interior central portion a photosensitive drum 1 as a photoreceptor. A cleaning device 4, a main eraser lamp 5, a main charger 6, a series of arrayed LEDs 7, a first developing device 8, a second developing device 9, a third developing device 10, a transfer charger 2 and a separation charger 3 are disposed in this order in a direction of rotation of the photosensitive drum 1 along the periphery thereof. An original glass plate 31 is provided on the top of the copying apparatus and, an optical system 32 for scanning an image of an original placed on the original glass plate 31 is disposed between the original glass plate 31 and the photosensitive drum 1. The optical system 32 is comprised of a light source 321, a plurality of movable mirrors 322, 323 and 324, a lens 325 and a plurality of fixed mirrors 326, 327 and 328.

In reproduction, the photosensitive drum 1 is initially charged by the main charger 6. The image of the original is then exposed to light by the optical system 32 so that an electrostatic latent image may be formed on the photosensitive drum 1. Toner supplied from one developing device which is selected from among three devices 8, 9 and 10 adheres to the electrostatic latent image to form a toner image on the photosensitive drum 1. This toner image is transferred onto a copy paper by the transfer charger 2 and is then separated along with the copy paper from the photosensitive drum 1 by the separation charger 3.

A paper supply cassette 16 is detachably mounted in the copying apparatus and a paper discharge tray 21 is hingedly connected to the apparatus on a side opposite to the paper supply cassette 16. A paper supply roller 15 is disposed above the paper supply cassette 16. Plural pairs of intermediate rollers 17, timing rollers 18, fixing rollers 20 and paper discharge rollers 25 are arrayed in this order from the paper supply cassette 16 towards the paper discharge tray 21, with the transfer charger 2 and the separation charger 3 being interposed between the timing rollers 18 and the fixing rollers 20.

The uppermost one of a plurality of copy papers accommodated in the paper supply cassette 16 is fed towards the paper transport path D by the paper supply roller 15 and reaches the timing rollers 18 by way of the intermediate rollers 17. Thereafter, the copy paper fed from the timing rollers 18 at a predetermined timing passes through the transfer charger 2 and the separation charger 3 so that the toner image formed on the photosensitive drum 1 may be transferred onto the copy paper. The copy paper then passes the fixing rollers 20 which fix the toner image. In the case of ordinary one-side copying, the copy paper having thereon the fixed toner image is introduced to the paper discharge rollers 25 and discharged on the paper discharge tray 21.

Between the fixing rollers 20 and the paper discharge rollers 25 is provided a first switching claw piece 26 which introduces the copy paper into either the paper discharge tray 21 or a passage (a) formed below it. A second switching claw piece 22 is provided at the terminal of the passage (a) and introduces the copy paper passed through the passage (a) into either a passage (b) or another passage (c). The passages (b) and (c) are provided with a pair of direction changing rollers 29 and a pair of guide rollers 27, respectively. An intermediate tray 24 is disposed downstream of the guide rollers 27 and, a paper supply roller 23 is disposed immediately above the intermediate tray 24. Furthermore, a pair of intermediate rollers 28 are disposed on the paper transport path D downstream of the paper supply roller 23.

In the case of composite copying in which copying operation is executed more than two times with respect to one face of a copy paper, the copy paper which has passed the fixing rollers 20 is introduced into the passage (a) by virtue of the first switching claw piece 26. The copy paper is then led into the passage (c) by virtue of the second switching claw piece 22 and discharged onto the intermediate tray 24 by way of the guide rollers 27. The copy paper temporarily stored on the intermediate tray 24 is fed into the paper transport passage D by the paper supply roller 23 so as to be again introduced to the timing rollers 18 by the intermediate rollers 28. Thereafter, the composite copying is executed in a manner such that the toner image formed on the photosensitive drum 1 is again transferred onto the copy paper by the transfer charger 2. The copy paper is then discharged onto the paper discharge tray 21 in double composite copying whereas it is caused to follow the same course again in triple composite copying.

In the case of duplex copying in which copying operation is executed with respect to both faces of a copy paper, the copy paper which has passed through the fixing rollers 20 is introduced into the passage (a) by the function of the first switching claw piece 26 and then into the passage (b) by the function of the second switching claw piece 22 and the direction changing rollers 29. Upon subsequent reverse rotation of the direction changing rollers 29, the direction of travel of the copy paper is reversed so that the copy paper may be led into the passage (c). Thereafter, the copy paper is led to the transfer charger 2 again by following the same course as in the composite copying.

Each of the developing devices 8, 9 and 10 can accommodate toner in any user's discretional color and is of the construction in which color discriminative information is given thereto by a dip switch in accordance with the color of toner accommodated therein. The dip switch produces a code of three bits, which is inputted into a CPU 200 through the corresponding one of three color discriminating portions 11, 12 and 13 disposed adjacent to respective developing devices 8, 9 and 10. The CPU 200 employed as a control means will be in detail explained hereinafter. The color of toner is discriminated on the basis of the combination of inputted high and low signals. In this embodiment, the first, second and third developing devices 8, 9 and 10 accommodate white, black and red toner, respectively. The white toner is electrically charged inside the first developing device 8 in the same polarity as that of the charged photosensitive drum 1 whereas the black toner and the red toner are done respectively inside the second and third developing devices 9 and 10 in the opposite polarity. The developing devices 8, 9 and 10 are provided with respective developing rollers **8*a*, 9*a* and 10*a* confronting the photosensitive drum 1. When any one of the developing devices 8, 9 and 10 is driven, a bias voltage is selectively applied to the corresponding developing roller 8*a*, 9*a* or 10*a*** from a transformer (not shown).

A color sensor 14 of any known type is disposed as a color detecting means above the paper supply cassette 16, for detecting the degree of white of the copy papers accommodated in the paper supply cassette 16. An output from the color sensor 14 is inputted into an analogue port of the CPU 200 so that the color discrimination may be executed in software. Furthermore, a white ratio detecting means 30 for detecting an area ratio of white portions (hereinafter referred to as a white area ratio) of an original is provided in the optical system 32. This means 30 may be a known AE sensor (original density detecting sensor), which is employed in this embodiment. An output from the AE sensor 30 is inputted into an analogue port of the CPU 200 so that the aforementioned area ratio may be detected in software.

Figure 2:
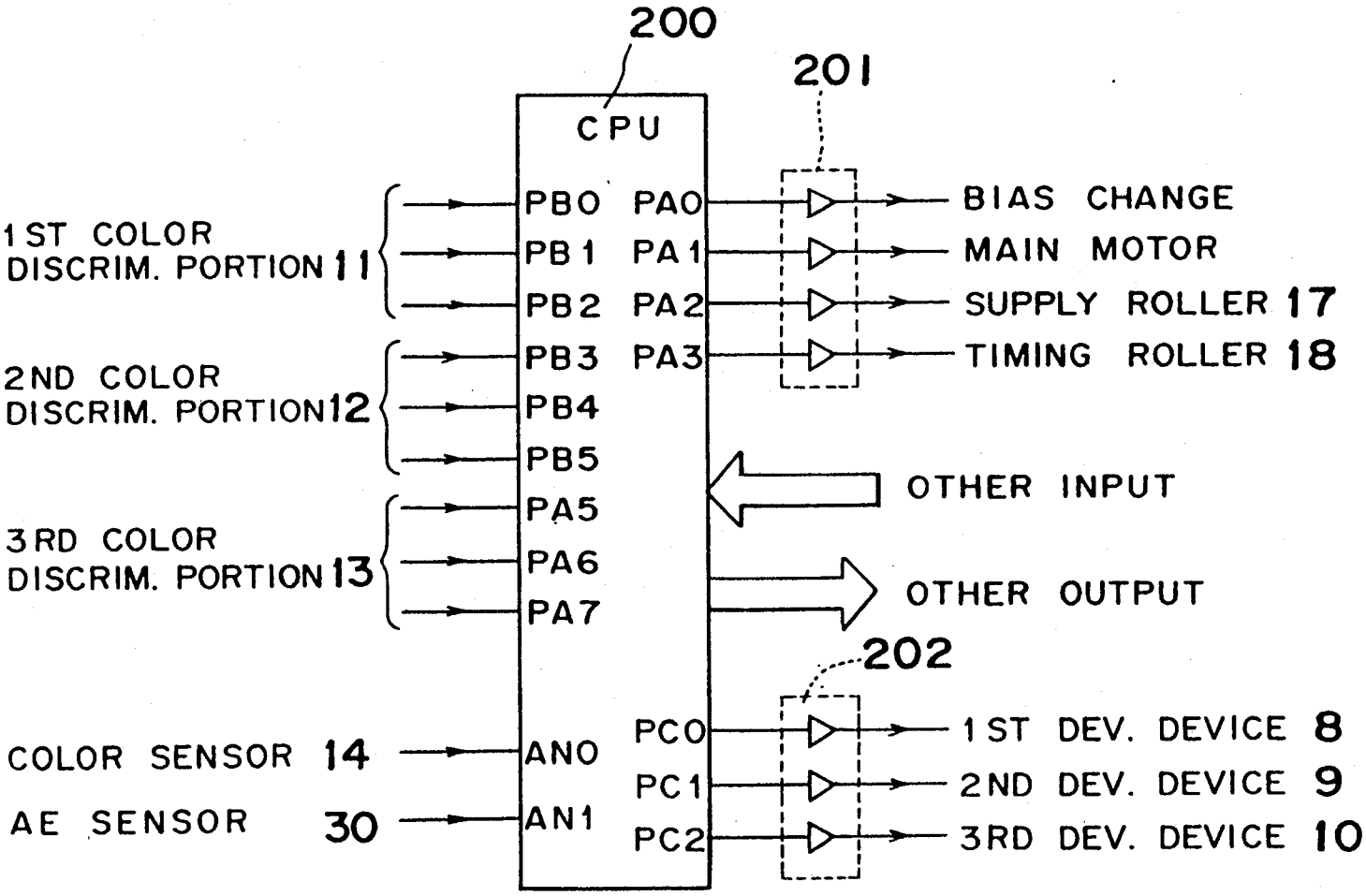
FIG. 2 is a block diagram indicative of the control of the copying apparatus of FIG. 1.

FIG. 2 depicts a control circuit of this embodiment, in which a one-chip microcomputer accommodating an A/D converter is employed as the CPU 200. Control signals for changing the level of development bias and for driving a main motor, the paper supply roller 15 and the timing rollers 18 are outputted to respective drivers 201 through output ports PA0, PA1, PA2 and PA3 of the CPU 200. Signals for controlling clutches which drive the corresponding developing devices 8, 9 and 10 are outputted from output ports PC0, PC1 and PC2 of the CPU 200 into respective drivers 202.

Each of three sets of input ports PB0 to PB2, PB3 to PB5 and PA5 to PA7 receives the three-bit color discriminative information for each developing device 8, 9 or 10. The CPU 200 discriminates the color of toner accommodated in each developing device 8, 9 or 10 on the basis of the color discriminative information. Input ports AN0 and AN1 are analogue ones which receive signals from the color sensor 14 and the AE sensor 30, respectively. The CPU 200 judges the color of copy papers and the white area ratio of the original in software on the basis of inputted signal levels.

Referring next to flow-charts of FIGS. 3, 4 and 5(1) to 5(6), the control procedure will be explained hereinafter.

Figure 3:
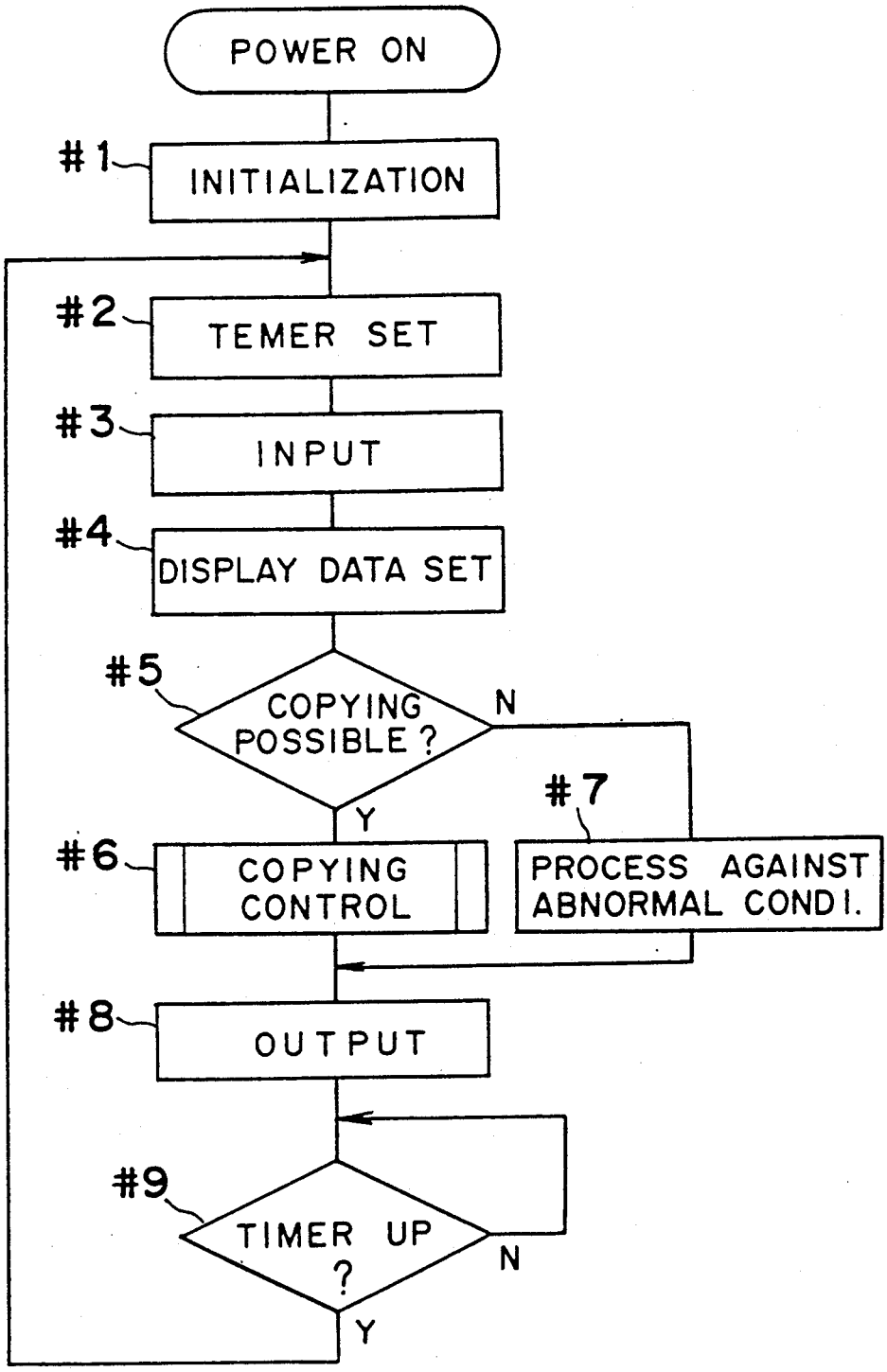
FIG. 3 is a flow-chart indicative of the main routine for controlling the copying apparatus.

The flow-chart of FIG. 3 is the main routine indicative of the control of the copying apparatus performed by the CPU 200. When a power source has been turned on, a RAM accommodated in the CPU 200 is cleared and initialized for an ordinary copying mode at step #1 followed by step #2 at which a timer accommodated in the CPU 200 is set. The timer restricts the period of time required for subsequent control i.e., that required for one routine. The input by several switches, sensors and other keys provided on an operation panel and the apparatus body is carried out at step #3 followed by step #4 at which display data in connection with the operated keys are set. Subsequently, it is judged at step #5 whether or not the copying operation can be executed. If possible, the control for the ordinary copying operation including the control for the stand-by condition is executed at step #6, whereas, if not possible, the process against the abnormal condition is executed at step #7. The control signals, display signals and the like are outputted at subsequent step #8 followed by step #9 at which it is judged whether or not the period of time set by the timer is up. If the time is up, the procedure proceeds to step #2 from which the above described process is repeated.

Figure 4:
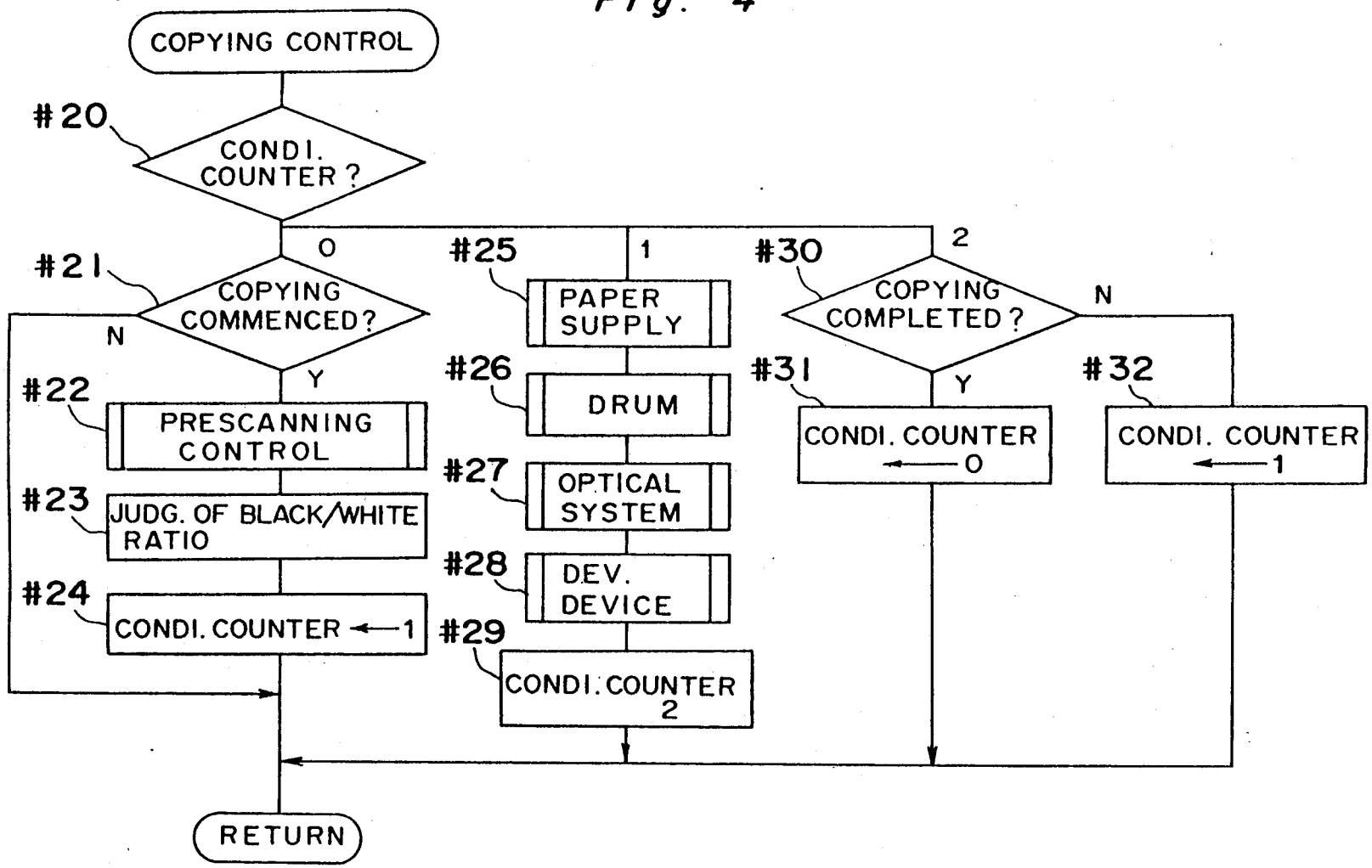
FIG. 4 is a flow-chart indicative of a subroutine for controlling the copying operation.

The subroutine for the control to be executed at step #6 is shown in FIG. 4. In this subroutine, prior to the ordinary copying mode, preliminary scanning is conducted in preparation for judgment with respect to the area ratio between black and white portions of an original. In connection with this, the CPU 200 accommodates a copying condition indicating counter, which is set to any one of 0, 1 and 2. The processing system to be used is selected on the basis of this value.

The copying condition indicating counter is initially set to 0. Upon judgment by the copying condition indicating counter at step #20, the procedure proceeds to step #21 at which it is judged whether or not a print button has been depressed to commence the copying operation. If the judgment at step #21 is YES, the control for the preliminary scanning is executed at step #22 followed by step #23 at which the black-white area ratio of the original is judged on the basis of the analogue input from the AE sensor 30. The copying condition indicating counter is then set to 1 at step #24, and thereafter, the procedure returns to the main routine. When the copying operation has not been commenced at step #21, the procedure immediately returns to the main routine.

In the next cycle, the fact that the copying condition indicating counter is set to 1 is judged at step #20 followed by step #25 at which the control for paper supply and transportation is executed. Furthermore, at subsequent steps #26, #27 and #28 are executed the control for the photosensitive drum 1 and its peripheral devices, that for the optical system 32 and that for the developing devices 8, 9 and 10, respectively. The copying condition indicating counter is then set to 2 at step #29, and thereafter, the procedure returns to the main routine.

In the subsequent cycle, the fact that the copying condition indicating counter is set to 2 is judged at step #20 followed by step #30 at which it is judged whether or not the copying operation for the required number of copies set by a user has been completed. If the copying operation has been completed, the copying condition indicating counter is set to 0 at step #31 and the procedure returns to the main routine. When the required number of copies is the plural number, the copying condition indicating counter is set to 1 at step #32 and the procedure returns to the main routine. Accordingly, the preliminary scanning and the judgment of the black-white area ratio are conducted with respect to the first copying operation whereas these are not done with respect to and after the second copying operation.

Figure 4A:
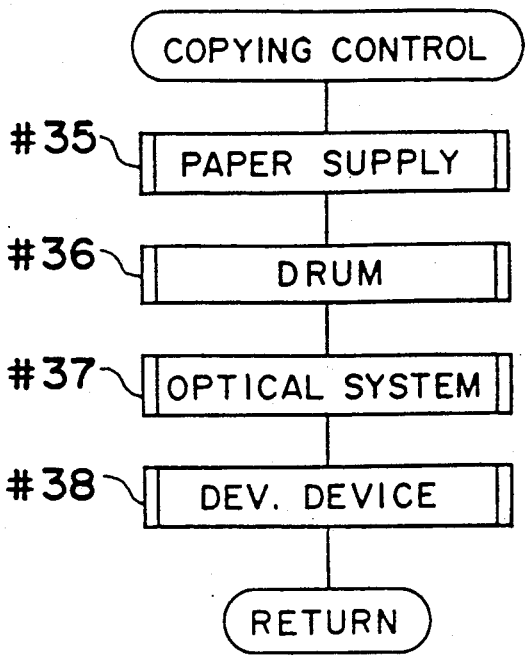
FIG. 4*a* is a flow-chart similar to FIG. 4, which particularly shows a modification thereof.

If the white portions of the original are required to be reproduced on a colored copy paper or papers irrespective of the white area ratio, the apparatus needs no AE sensor 30 and the flow-chart of FIG. 4 can be replaced by another flow-chart as shown in FIG. 4*a*.

In the flow-chart of FIG. 4*a*, the control for paper supply and transportation is executed at step #35. At subsequent steps #36, #37 and #38 are executed the control for the photosensitive drum 1 and its peripheral devices, that for the optical system 32 and that for the developing devices 8, 9 and 10, respectively. The procedure then returns to the main routine.

Figure 5:
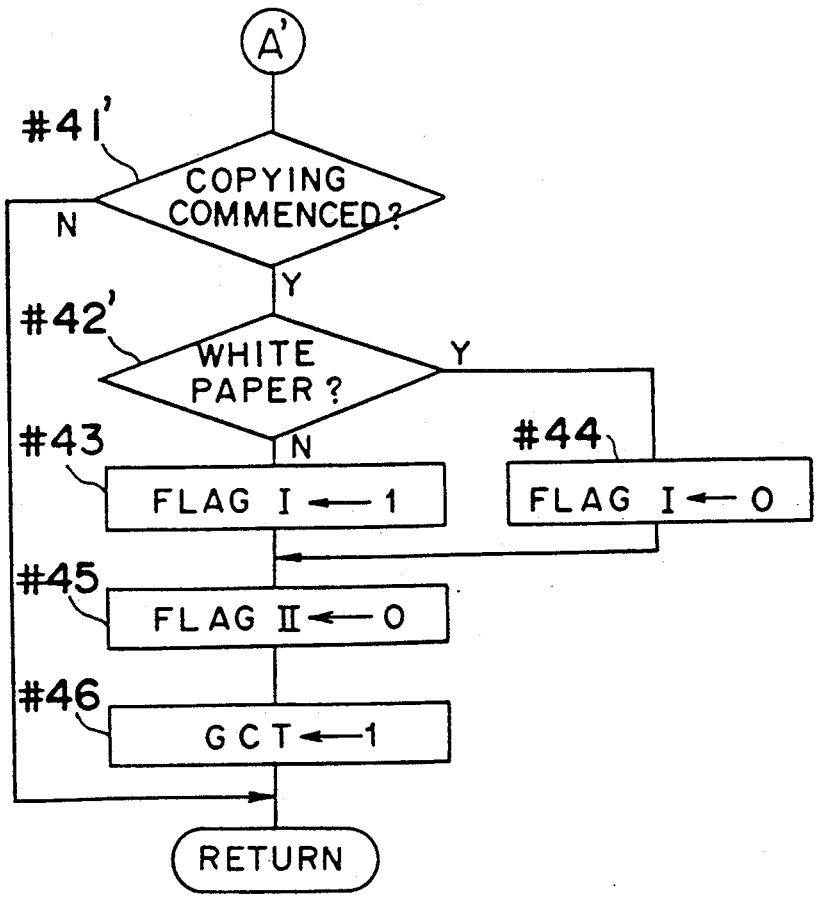
FIGS. 5(1) to 5(6) are flow-charts indicative of subroutines for controlling developing devices provided in the copying apparatus.
Figure 5:
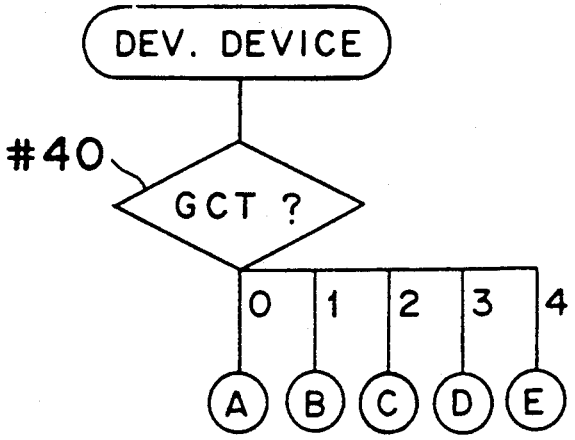
Figure 5:
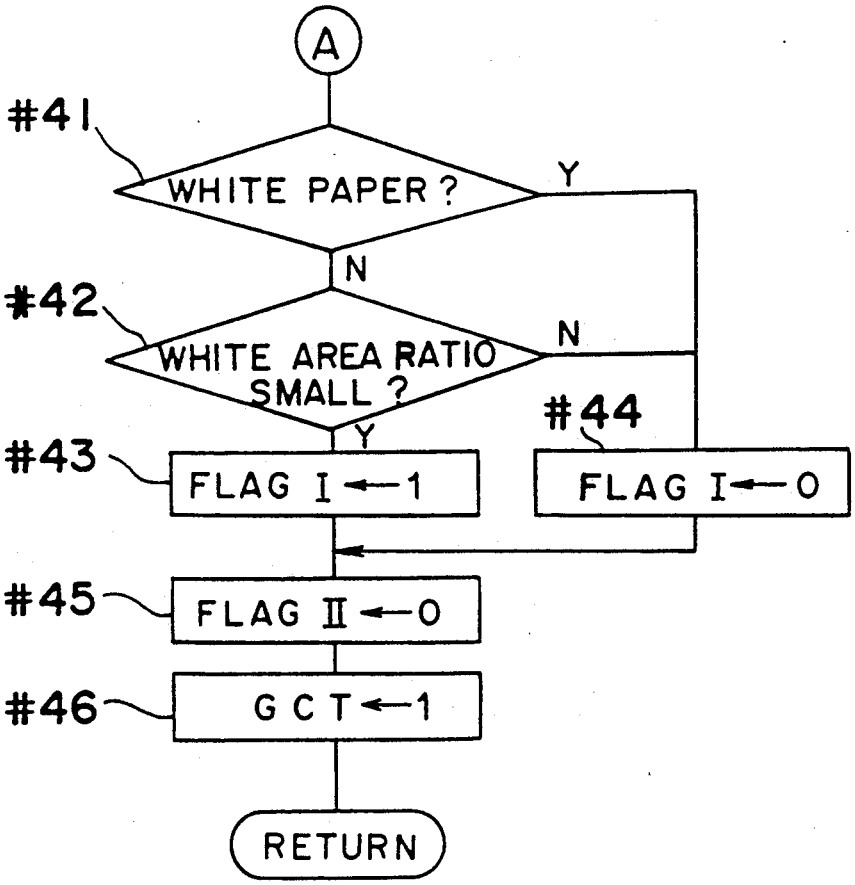
Figure 5:
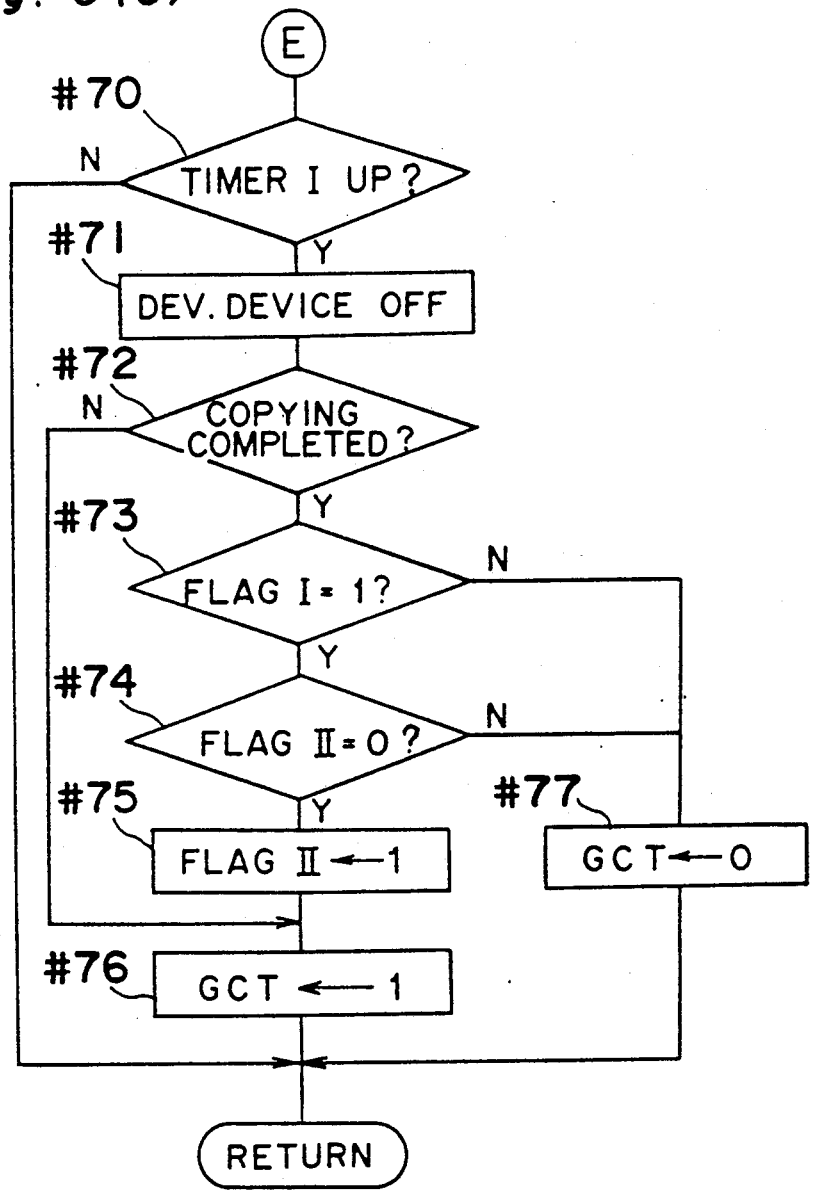

The subroutine of step #28 for controlling the developing devices 8, 9 and 10 is shown in FIGS. 5(1) to 5(6). In this subroutine, the developing devices 8, 9 and 10 are controlled in accordance with the input from the sensors, switches and the like. To this end, a developing device condition indicating counter (GCT) which is set to any one of 0, 1, 2, 3 and 4 is provided.

This subroutine will be explained hereinafter by taking the case in which the original is a photograph having a white area ratio smaller than the predetermined value, the copy paper is a colored paper, the set number of copies is 1 and the copying operation is carried out using black toner.

The device condition indicating counter (GCT) is initially set to 0, to thereby select the process A at step

#40. It is judged at step #41 whether or not the copy paper is white on the basis of the information from the color sensor 14. At subsequent step #42, it is judged whether or not the white area ratio of the original is smaller than the predetermined value. In this example, since the colored paper is used and the white area ratio of the original is smaller than the predetermined value, a flag I is set to 1 at step #43 and another flag II to 0 at step #45. Furthermore, the GCT is set to 1 at step #46, and thereafter, the procedure returns to the main routine. When it is judged at step #41 that the copy paper is white or when it is judged at step #42 that the white area ratio of the original is greater than the predetermined value, the flag I is set to 0 at step #44 followed by step #45.

The process A can be replaced by the process A' shown in FIG. 5(2*a*) in the case where the white portions of the original is required to be reproduced on a colored copy paper irrespective of the white area ratio.

In the process A', it is judged at step #41' whether or not the copying operation should be commenced i.e., the print button has been depressed. If the judgment at step #41' is NO, the procedure immediately returns to the main routine. On the contrary, if the judgment at step #41' is YES, it is judged at step #42' whether or not the copy paper is white on the basis of the information from the color sensor 14. If the copy paper is the colored one, the procedure proceeds to step #43 whereas, if the copy paper is white, the procedure proceeds to step #44. The steps #43 to 46 in the process A' is the same as those in the process A.

In the next cycle, since the GCT is 1, the process B is selected at step #40. Subsequently, it is judged at step #50 whether or not the flag I is 0. In this example, since the flag I is 1 due to the fact that the colored copy paper is used and the white area ratio of the original is smaller than the predetermined value, the procedure proceeds to step #54 at which it is judged whether or not the flag II is 0. Since the flag II is 0, the procedure proceeds to step #51 at which the second developing device 9 containing therein black toner is selected. Furthermore, the bias level is set to 1 at step #52 followed by step #53 at which the GCT is set to 2, and thereafter, the procedure returns to the main routine. If the flag I is judged at step #50 to be 0 which means that the white copy paper is used or the white area ratio of the original is greater than the predetermined value, the procedure immediately proceeds to step #51. When the flag II is judged at step #54 to be 1, the procedure proceeds to step #55 at which the first developing device 8 containing therein white toner is selected. The bias level is then set to 2 at step #56 followed by step #53.

In the subsequent cycle, since the GCT is 2, the process C is selected at step #40. Then, it is judged at step #60 whether or not image formation should be commenced. If the judgment at step #60 is YES, the selected developing device is turned on at step #61. In this example, the development is carried out with the use of black toner because the developing device 9 containing therein black toner is selected. The procedure then returns to the main routine after the GCT has been set to 3 at step #62. When the judgment at step #60 is NO, the procedure immediately returns to the main routine. If the developing device 8 containing therein white toner is selected, the development is carried out with the use of white toner.

In the next cycle, since the GCT is 3, the process D is selected at step #40. Subsequently, it is judged at step #63 whether or not the image formation has been completed. In this example, the development is being carried out with the use of black toner contained in the developing device 9, and therefore, the development has not been completed and the procedure returns to the main routine. This process D is repeatedly carried out and the ordinary copying of the original i.e., the photograph in this example is executed with respect to the colored copy paper using black toner. The development at this time is the ordinary positive-positive one and the bias level for development is selectively set to 1 which is suitable for the positive-positive development, as described hereinbefore. In this way, the development is carried out using black toner. When it is judged at step #63 that the image formation has been completed, a timer I is set at step #64 and the GCT is set to 4 at step #65. Then, the procedure returns to the main routine. The aforementioned timer I sets the period of time within which the end of charged portion of the photosensitive drum 1 passes the selected developing device.

In the next cycle, since the GCT is 4, the process E is selected at step #40. Subsequently, it is judged at step #70 whether or not the timer I is up. If the timer is not up, the procedure returns to the main routine. If it is judged at step #70 that the timer I is up, the developing device 9 containing therein black toner is turned off at step #71 followed by step #72 at which it is judged whether or not the copying operation has been completed by the set number of copies. In this example, since the set number of copies is 1, it is judged that the copying operation has ended and the procedure proceeds to step #73 at which it is judged whether or not the flag I is 1. The fact that the flag I is 1 in this example causes the procedure to proceed to step #74 at which it is judged whether or not the flag II is 0. Since the flag II has already been set to 0 at step #45, the procedure proceeds to step #75 at which the flag II is changed to 1. At subsequent step #76, the GCT is set to 1 and the procedure returns to the main routine, to thereby complete the development with the use of black toner. If it is judged at step #72 that the copying operation has not been completed by the set number of copies, the procedure jumps to step #76 so that the development may be carried out by the required number of copies using black toner. Furthermore, if the flag I is judged to be 0 at step #73 or if the flag II is judged to be 1 at step #74, the GCT is set to 0 at step #77 and the procedure returns to the main routine.

The ordinary copying process, in which the black toner is used, is carried out in the above described manner. In this embodiment, the above process is followed by another copying process using white toner so that the composite copying may be executed. The copy paper which has undergone the copying operation by black toner passes through the transport path for the composite copying and is in a condition in which the copying operation is available using white toner. This process is initiated under the condition in which the GCT is 1, the flag I is 1 and the flag II is 1.

Accordingly, in the subroutine for controlling the developing devices, the process B is initially selected at step #40. Moreover, the developing device 8 containing therein white toner is selected at steps #50 and #54 and the bias level is selectively set to 2 at steps #55 and #56. In the subsequent processes C, D and E, the development by white toner is carried out at step #61 and after it has been judged at step #63 that the image formation with the use of white toner has ended, the copying process by white toner ends upon lapse of the predetermined period of time. Thereafter, the GCT is set to 0 at step #77 and the procedure returns to the main routine. In this event, the flags I and II are kept to be 1.

Figure 6:
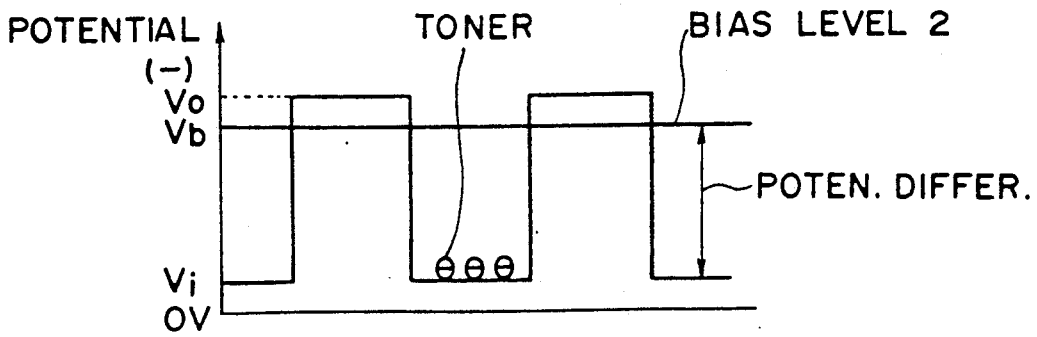
FIG. 6 is a graph for explaining reverse development.

The aforementioned copying process by white toner is carried out by making use of the negative-positive development i.e., the reversal development. More specifically, as shown in FIG. 6, bias potential Vb of the level 2, which is close to the maximum potential VO of the image portion formed on the photosensitive drum 1, is applied to the developing roller 8*a* of the first developing device 8 containing therein white toner having the same polarity as that of the charged photosensitive drum 1. The maximum potential VO corresponds to the black portions of the original and is equal to the potential thereof. Thus, potential difference for development is provided between the bias potential and the minimum potential Vi of the image portion of the photosensitive drum 1 so that the white toner may adhere to the image portion having the minimum potential which corresponds to the white portions of the original and is close to OV upon exposure. In this way, the white portions of the original are reproduced in white on the colored copy paper using the white toner.

Upon the above double composite copying processes, the white portions of the original image are reproduced on the colored copy paper using the white toner whereas other portions except for the white portions are reproduced using the black toner.

It is to be noted here that in the above embodiment, although the image formation by the black toner is performed prior to that by the white toner, the former may be performed immediately after the latter.

Furthermore, when the original document is a negative document such as a film, the black toner should be electrically charged in the same polarity as that of the charged photosensitive drum 1 whereas the white toner should be electrically charged in the opposite polarity.

In the above embodiment, if a white copy paper is used, only the ordinary copying process is executed using the black toner developing device 9, since the flag I equals 1 at step #50. Furthermore, if the set number of copies is the plural number, the ordinary copying process is repeatedly carried out by the number of copies using the black toner, and subsequently, the copying process by the white toner is repeated by the same number. In addition, the ordinary copying may be carried out using colored toner in place of the black toner.

The present invention is of wide application. For example, assuming that a multi-color copying apparatus is provided with a developing device of white toner in addition to developing devices of magenta, cyan and yellow toner, when white copy papers are used, the white portions of an original can be reproduced by the white toner during multiple transfer.

From the foregoing, even when colored copy papers are used, the white portions of the original can be reproduced in white using the irreducible minimum of the white toner. Moreover, when white copy papers are used, the copying operation can be carried out with economy of time.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An image forming apparatus provided with a plurality of toner developing devices including a white toner developing device, said apparatus comprising:
   - a photosensitive member;
   - a means for electrically charging a surface of said photosensitive member;
   - an exposure means for exposing an image of an original so that an electrostatic latent image may be formed on said photosensitive member;
   - a first developing means for developing the electrostatic latent image formed on said photosensitive member, said first developing means containing toner charged in polarity opposite to the polarity of said charged photosensitive member;
   - a transfer means for transferring a toner image formed on said photosensitive member onto a copy paper;
   - a transporting means for transporting the copy paper having thereon the transferred toner image into a transfer region in which said transfer means is provided;
   - a second developing means for developing the electrostatic latent image formed on said photosensitive member, said second developing means containing white toner charged in the same polarity as the polarity of said charged photosensitive member;
   - a white detecting means for detecting the degree of white of the copy paper; and
   - a control means for transferring a toner image formed by said second developing means onto the copy paper when the degree of white of the copy paper is less than a predetermined value.

2. The apparatus according to claim 1, wherein the toner image formed by said second developing means is transferred onto the copy paper on which the toner image formed by said first developing means has already been transferred.

3. An image forming apparatus provided with a plurality of toner developing devices including a white toner developing device, said apparatus comprising:
   - a photosensitive member;
   - a means for electrically charging a surface of said photosensitive member;
   - an exposure means for exposing an image of an original to light so that an electrostatic latent image may be formed on said photosensitive member;
   - a first developing means for developing the electrostatic latent image formed on said photosensitive member, said first developing means containing toner charged in polarity opposite to the polarity of said charged photosensitive member;
   - a transfer means for transferring a toner image formed on said photosensitive member onto a copy paper;
   - a transporting means for transporting the copy paper having thereon the transferred toner image into a transfer region in which said transfer means is provided;
   - a second developing means for developing the electrostatic latent image formed on said photosensitive member, said second developing means containing white toner charged in the same polarity as the polarity of said charged photosensitive member;

a white detecting means for detecting the degree of white of the copy paper;

a white area ratio detecting means for detecting an area ratio of white portions of the original; and a control means for transferring a toner image formed by said second developing means onto the copy paper when the degree of white of the copy paper is less than a predetermined value and the area ratio of the white portions of the original is less than a predetermined ratio.

4. The apparatus according to claim 3, wherein the toner image formed by said second developing means is transferred onto the copy paper on which the toner image formed by said first developing means has already been transferred.

5. An image forming apparatus provided with a plurality of toner developing devices including a white toner developing device, said apparatus comprising:

a photosensitive member;

a means for electrically charging a surface of said photosensitive member;

an exposure means for exposing an image of an original so that an electrostatic latent image may be formed on said photosensitive member;

a first developing means for developing the electrostatic latent image formed on said photosensitive member, said first developing means containing toner charged in the same polarity as the polarity of said charged photosensitive member;

a transfer means for transferring a toner image formed on said photosensitive member onto a copy paper;

a transporting means for transporting the copy paper having thereon the transferred toner image into a transfer region in which said transfer means is provided;

a second developing means for developing the electrostatic latent image formed on said photosensitive member, said second developing means containing white toner charged in polarity opposite to the polarity of said charged photosensitive member;

a white detecting means for detecting the degree of white of the copy paper; and a control means for transferring a toner image formed by said second developing means onto the copy paper when the degree of white of the copy paper is less than a predetermined value.

6. The apparatus according to claim 5, wherein the toner image formed by said second developing means is transferred onto the copy paper on which the toner image formed by said first developing means has already been transferred.

7. An image forming apparatus provided with a plurality of toner developing devices including a white toner developing device, said apparatus comprising:

a means of electrically charging a surface of said photosensitive member;

an exposing means for exposing an image of an original so that an electrostatic latent image may be formed on said photosensitive member;

a first developing means for developing the electrostatic latent image formed on said photosensitive member;

a transfer means for transferring a toner image formed on said photosensitive member onto a copy paper;

a transporting means for transporting the copy paper having thereon the transferred toner image into a transfer region in which said transfer means is provided;

a second developing means for developing the electrostatic latent image formed on said photosensitive member, said second developing means containing white toner charged in polarity opposite to the polarity of toner contained in said first developing means;

a white detecting means for detecting the degree of white of the copy paper; and a control means for transferring a toner image formed by said second developing means onto the copy paper when the degree of white of the copy paper is less than a predetermined value.

* * * * *